US006044594A

United States Patent [19]

Desselle

[11] Patent Number: 6,044,594

[45] Date of Patent: Apr. 4, 2000

[54] WEEP HOLE BARRIER

[76] Inventor: Douglas P. Desselle, 1318 Dulock, Houston, Tex. 77055

[21] Appl. No.: 09/157,031

[22] Filed: Sep. 18, 1998

[51] Int. Cl.[7] ..... E04B 1/70

[52] U.S. Cl. ..... 52/101; 52/302.3

[58] Field of Search ..... 52/101, 302.1, 52/302.3, 302.7

[56] References Cited

U.S. PATENT DOCUMENTS

| | | | |
|---|---|---|---|
| D. 372,068 | 7/1996 | Disanto | D22/119 |
| 3,429,084 | 2/1969 | Brewer | 52/302.1 X |
| 4,102,093 | 7/1978 | Harris | 52/101 |
| 4,587,892 | 5/1986 | Witten et al. | 52/302.1 X |
| 4,669,371 | 6/1987 | Sarazen, Jr. et al. | 52/302.1 X |
| 5,203,795 | 4/1993 | Balamut et al. | 52/302.1 |
| 5,274,968 | 1/1994 | Pardo | 52/302.3 X |
| 5,349,799 | 9/1994 | Schiedegger et al. | 52/302.1 X |
| 5,870,864 | 2/1999 | Snyder et al. | 52/302.1 X |

*Primary Examiner*—Carl D. Friedman
*Assistant Examiner*—Kevin D. Wilkens
*Attorney, Agent, or Firm*—Robert W B Dickerson

[57] ABSTRACT

A mesh apparatus positionable with respect to a weep hole in a masonry wall so as to bar passage by insects, rodents or other pests through the weep hole; the apparatus including a frame having a central screen and may include a structural support member for releasably securing the apparatus to the wall.

5 Claims, 3 Drawing Sheets

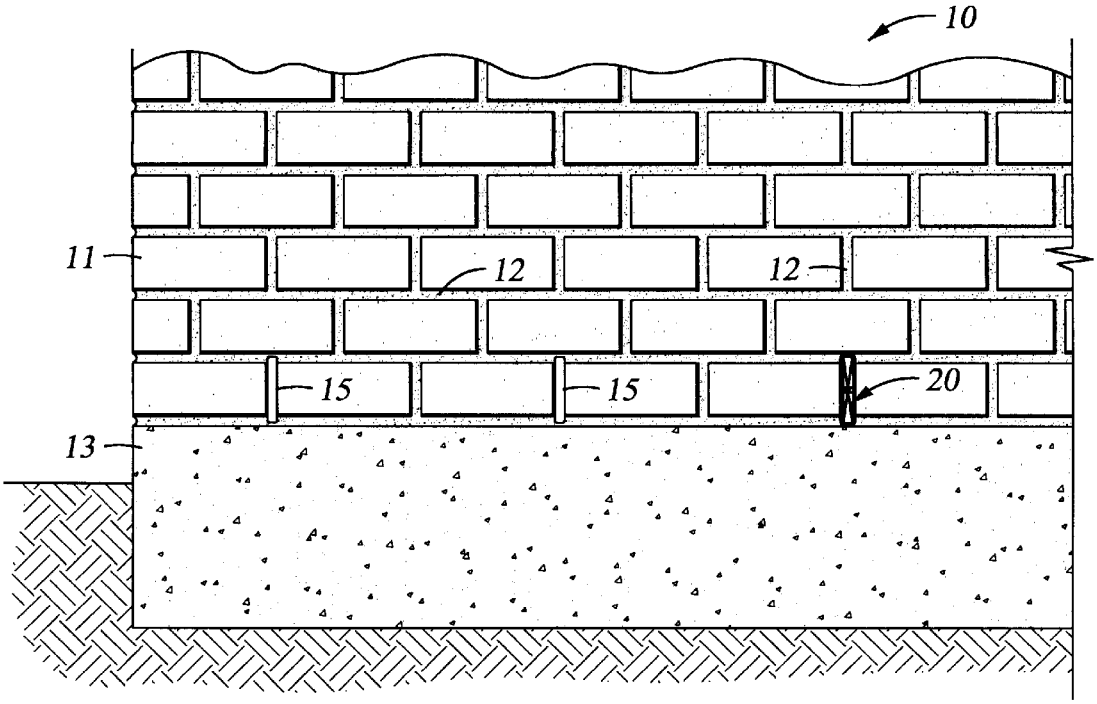
Fig. 1A
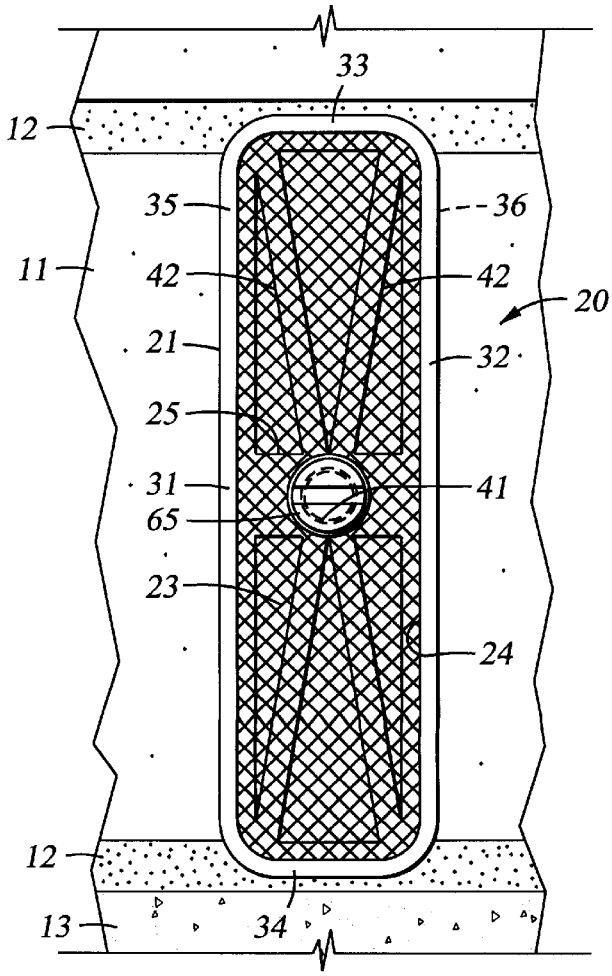
Fig. 1-B

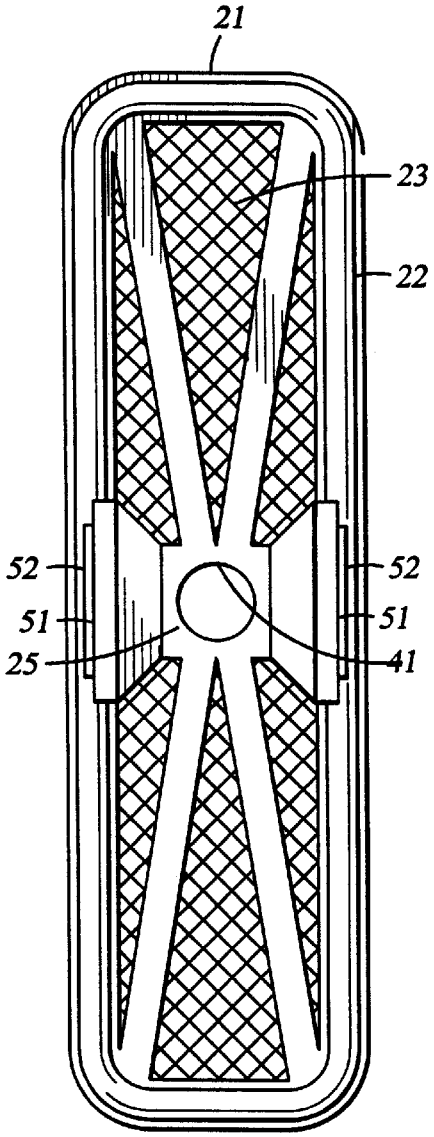
Fig. 2
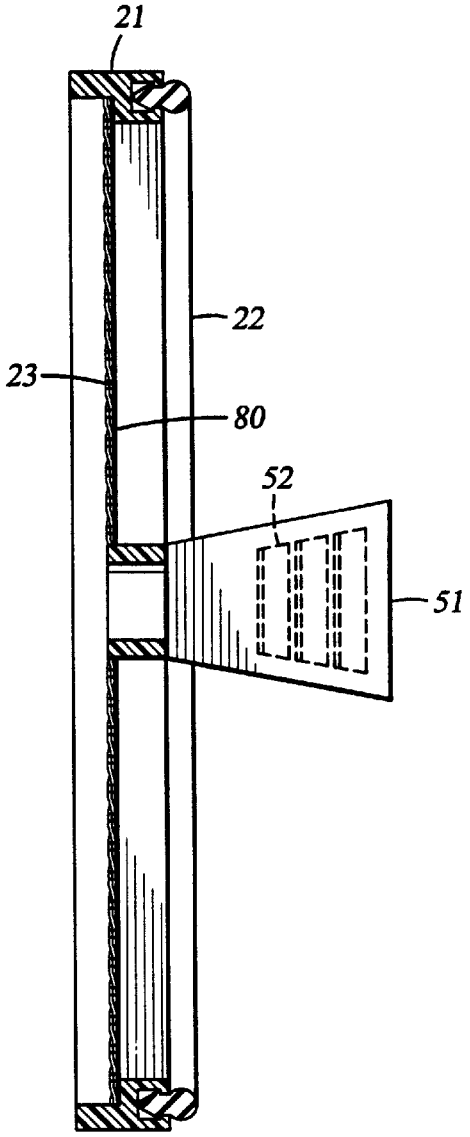
Fig. 2-A
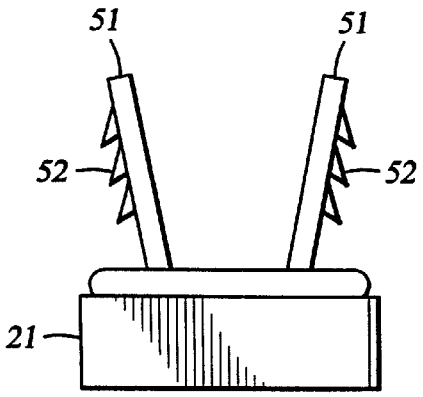
Fig. 2-B

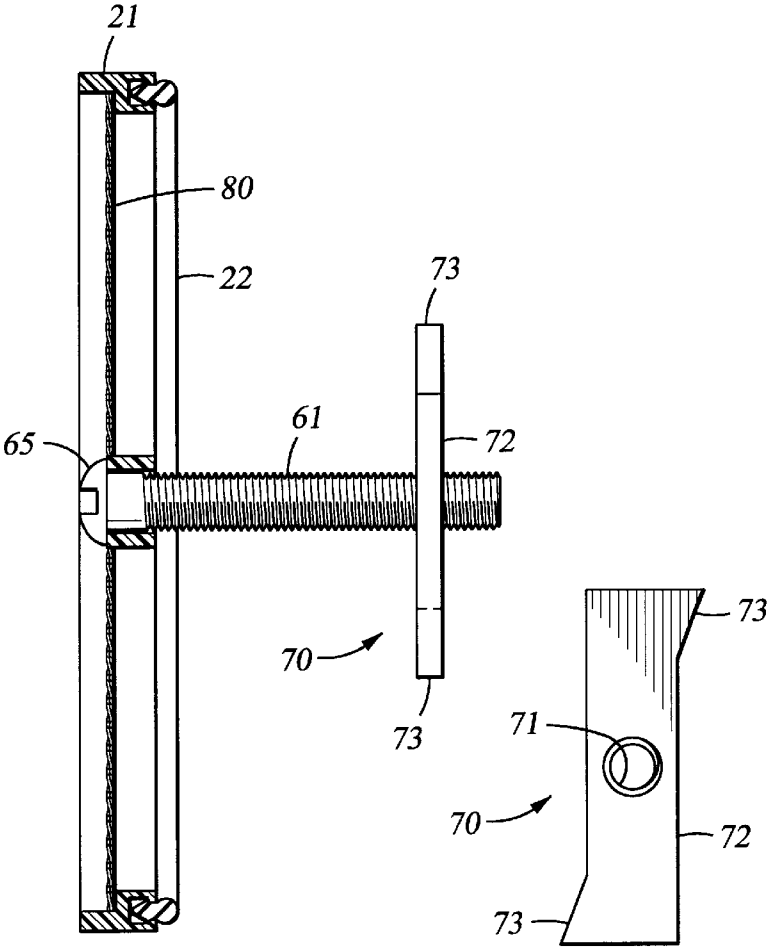
Fig. 4-A
Fig. 4-B
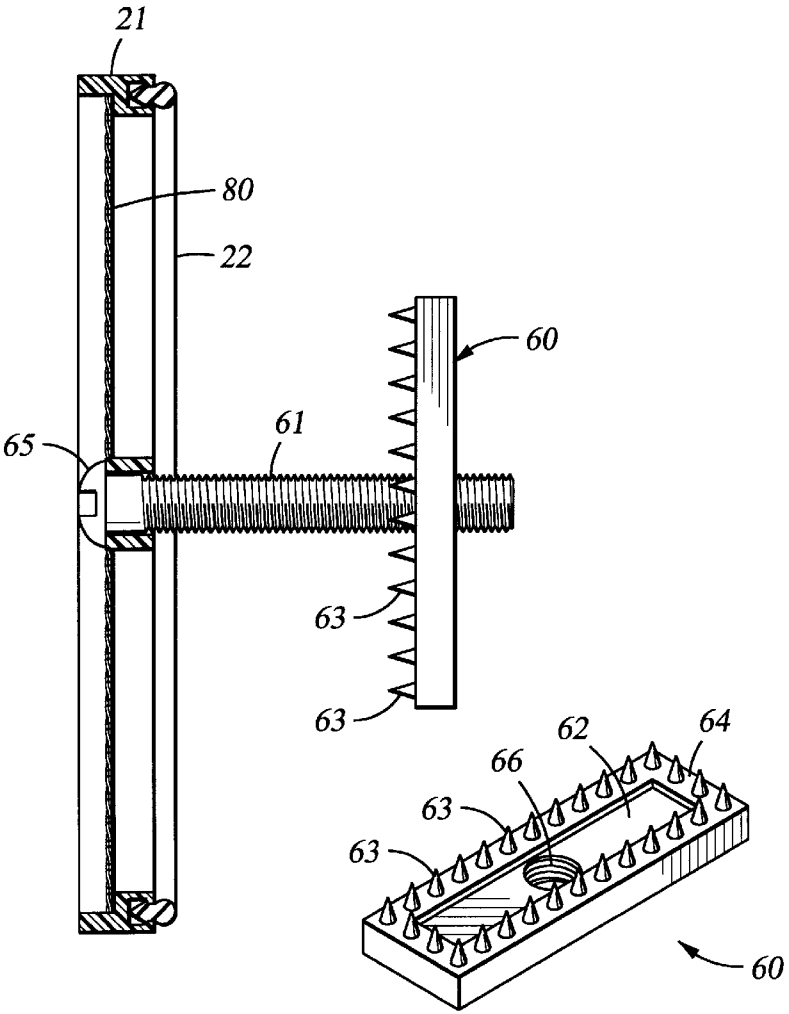
Fig. 3-A
Fig. 3-B

WEEP HOLE BARRIER

BACKGROUND OF THE INVENTION

Masonry walls, and particularly brick walls, comprise some of the most popular and durable products used for the exterior finishes provided to residences as well as to commercial buildings. Such materials outlast most other materials. Their colors are generally not affected by the elements, and they require little maintenance.

In the construction of such a wall, the individual bricks are stacked or laid side by side, forming a row, followed by additional rows, one atop the other. The individual bricks of each row are generally staggered by roughly one half of a brick length from the bricks immediately above and below. With the exception of the weep hole space hereinafter described, each brick is bonded, on each of its sides to its adjacent surfaces, by mortar. The lowermost row of bricks contains weep holes which are periodically provided, every two or three bricks. A weep hole is simply an open or un-mortared space, usually vertically arranged between adjacent bricks or other masonry building materials.

These weep holes are intended to prevent water build-up on the interior of the wall. It is understood that a brick wall is not waterproof. Some water, usually coming from rain or condensation, is absorbed by the brick. Most, however, is absorbed by the mortar. Thereafter, much of it runs down the interior surface of the wall. In the absence of the weep holes, the water could build up and gravity flow into the interior of the house. By providing weep holes, the tendency of the aforementioned water build up is lessened. With the bitter, however, comes the sweet. Weep holes, by themselves, provide open communication between the great and not so great outdoors and the interior of the structure. The interior space between the brick and the residence wall is dark and moist. This represents an open invitation to all sorts of unwanted rodents, insects, snakes, spiders and other pests. Applicant's invention is intended to provide the best of both these worlds, the prevention of water buildup behind the wall and the provision of a barrier to most unwanted pests.

SUMMARY OF THE INVENTION

The barrier of this invention includes a generally rectangularly configured housing carrying a mesh-like screen centrally thereof, with a blocking member secured to the housing. The housing's frame carries a peripheral seal therearound for engagement with the outer surface of the wall, around the weep hole. Structural reinforcing or bracing means is normally provided to the barrier providing strength and permitting receipt of fastener means for securing the barrier to the wall. This fastener means may take a number of forms, including (a) spring members, depending from the bracing means, having tangs for engagement with the bricks, (b) and holding brackets adjustable relative to a bolt and also engageable with the bricks so as to secure the inventive device to the wall.

DESCRIPTION OF THE DRAWINGS

FIG. 1-A is a front view of a portion of a brick wall having weep holes and the barrier of this invention positioned at one of said weep holes;

FIG. 1-B is an enlarged detail of a portion of 1-A in the area of the barrier showing its front side;

FIG. 2 is a rear view of the barrier;

FIG. 2-A is a vertical axial section through the barrier with a first embodiment of the fastener;

FIG. 2-B is a top elevation of the fastener of FIG. 2-A;

FIGS. 3-A and 3-B are, respectively, a vertical section through the barrier with a second embodiment of the fastener and a front perspective of the fastener of FIG. 3-A; and FIGS. 4-A and 4-B, respectively, are a vertical section through the barrier with a third embodiment of the fastener and a front elevation of the fastener of FIG. 4-A.

DESCRIPTION OF A PREFERRED EMBODIMENT

FIG. 1-A illustrates the front side of a typical brick wall 10, with each brick 11 secured to each adjacent brick by mortar 12. The lowermost brick row is secured to slab 13. The said lowermost row includes spaced weep holes 15, normally approximately every third or fourth brick. Such a weep hole is simply an open passageway between bricks for preventing the accumulation of water behind the wall 10. Such open passageways are formed by not providing mortar between two adjacent bricks. The barrier 20 of this invention is generally shown in FIG. 1-A, with an enlarged detail thereof illustrated in FIG. 1-B and sections thereof in FIGS. 2-A, 3-A, and 4-A.

The barrier's housing includes a rectangular frame 21, having sides 31, 32, top 33, bottom 34, front 35 and rear 36. The rear face of the frame includes a depending, continuous, rubber-foam bead 22, surrounding the frame's centrally positioned passageway 24 which receives screen or mesh 23. Blocking member 80, preferably formed of water pervious mesh cloth, is adhered to the rear face of mesh 23. Cross piece 25, as shown, extends between frame sides 31 and 32, and is centrally apertured by threaded aperture 41. Additional structure support, if required, may be provided by cross bracing 42, comprising intersecting rods. If desired, such bracing 42 may carry an annularly threaded bolt-receiving aperture, thereby substantially replacing cross piece 25. The entire barrier housing, compromising frame 21, screen 23, cross piece 25 and/or bracing 42, may be made integral for sealing engagement against the front face of wall 10. Mesh cloth 80 would be fabricated or cut to size to be adhered to the housing.

Means, for releasably securing the invention against the front face of the wall are provided. The preferred embodiment, as shown in FIGS. 2-A, 2-B, provides a pair of wings comprising tang-containing, spring-like members 51, depending from cross piece 25 and extending rearwardly of housing frame 21. On urging such spring members toward each other, against their normal bias, members 51 may be urged into one weep hole 15. The direction of tangs 52 permits urging the springs toward the rear of the brick wall until seal 22 comes into contact with the front wall face surrounding the weep hole. On removal of the user's finger pressure on insertion of springs 51 and 52, the spring tension normally urges the springs apart and against the adjacent brick. The tang direction thereafter opposes removal of the springs from the weep hole and thereby tends to prevent removal of the barrier from its blocking position adjacent the weep hole. So long as the barrier remains in its ready position, the blocking member comprising mesh cloth 80 will block the passage of substantially any pest, yet allow water to flow outwardly from behind wall 10.

A second securing means embodiment is illustrated by FIGS. 3-A, 3-B. There, threaded bolt 61 is inserted through aperture 41 (through either or both of cross piece 25 or bracing 42), after having fastener 60 movably positioned on one end of said bolt. Said fastener is rectangularly configured, having a threaded aperture 66 through a central web 62, and having nibs or tangs 63 on one face 64 of the fastener. After positioning the barrier frame around a weep hole and insertion of the threaded bolt end through the weep hole so that the said bolt's one end extends beyond the wall bricks, a user can reach behind the wall and rotate fastener 60 until the bolt head 65 is snugly urged against the cross piece 25 or bracing 42 and the fastener tangs bite into the rear wall surface.

A still further securing means is illustrated by FIGS. 4-A and 4-B. Like the FIG. 3-A embodiment, there would be a threaded bolt 61 having a head 65. Likewise there is a fastener 70 having a threaded aperture 71 centrally therethrough. Unlike the fastener of FIG. 3-A, the rectangular body 72 of FIG. 4-B includes a single tang 73 at each of the opposite body ends. Such tangs are oppositely facing. In use, after insertion of fastener 70 on the threaded end of bolt 61, the fastener is inserted only partially through the weep hole, when seal 22 engages the front face of wall 10. Because of the tangs 73, after a slight rotation of the fastener, such tangs will bite into the adjacent brick surfaces. Continued bolt rotation will urge the bolt head snugly against the front face of the cross piece 25 or the bracing 42, whichever one or ones may be used.

It should be clear that whichever one of the securing means embodiments is used, that after positioning the barrier so that the seal bead surrounds one entrance to the weep hole, access to such passageway and therethrough into the adjacent structure by pests of any size is barred or drastically reduced, by the mesh cloth 80 and screen 23, while water may be evacuated. It should also be realized that removal and replacement is readily accomplished. Although limited embodiments have been described, numerous modifications would be possible by one skilled in the art without departing from the spirit of the invention, the scope of which is limited only by the following claims.

I claim:

1. A weep hole barrier for use in conjunction with a masonry wall, said barrier comprising:

housing including a peripheral frame;

pest restricting means positioned centrally of said frame;

seal means engageable with one face of said wall surrounding an entrance into a weep hole;

means for causing sealing engagement between said seal means and said wall;

and including structural reinforcing means provided on said housing extending across said pest restricting means.

2. A weep hole barrier for use in conjunction with a masonry wall, said barrier comprising:

housing including a peripheral frame;

pest restricting means positioned centrally of said frame;

seal means engageable with one face of said wall surrounding an entrance into a weep hole;

means for causing sealing engagement between said seal means and said wall;

said engagement causing means includes a pair of movable spring-like wings secured to said housing, said wings including tangs adapted to restrict removal of said barrier from its associated weep hole; and structural reinforcing means provided on said housing extending across said pest restricting means.

3. The barrier of claim 2 wherein said wings depend from said structural reinforcing means.

4. A weep hole barrier for use in conjunction with a masonry wall, said barrier comprising:

housing including a peripheral frame;

pest restricting means positioned centrally of said frame;

seal means engageable with one face of said wall surrounding an entrance into a weep hole;

means for causing sealing engagement between said seal means and said wall;

said engagement causing means includes threaded bolt means adapted to be inserted, at least partially, into said weep hole, said bolt means having a free end and a head secured to said bolt means oppositely to said free end and adapted to be seated against a central portion of said housing;

fastener means threadedly engageable with said bolt's free end, said fastener means including rotation restricting means engageable with another face of said wall opposite to said one face; and including structural reinforcing means provided on said housing extending across said pest restricting means, said structural reinforcing means including bolt passageway means for receiving said bolt.

5. A weep hole barrier for use in conjunction with a masonry wall, said barrier comprising:

housing including a peripheral frame;

pest restricting means positioned centrally of said frame;

seal means engageable with one face of said wall surrounding an entrance into a weep hole;

means for causing sealing engagement between said seal means and said wall;

said engagement causing means includes threadedly engageable fastener means adapted to enter said weep hole;

said fastener means including tang means at opposite ends of said fastener means for engaging said wall adjacent said weep hole, and threaded bolt means having a threaded end and a head at the opposite end, said head being engageable with said housing, centrally thereof, said fastener means being threadedly engageable with said bolt means' threaded end; and structural reinforcing means provided on said housing extending across said pest restricting means, said reinforcing means including bolt passageway means for receiving said bolt.

* * * * *